US006178965B1

(12) United States Patent
Sulak

(10) Patent No.: US 6,178,965 B1
(45) Date of Patent: Jan. 30, 2001

(54) STOWABLE FIREPLACE

(76) Inventor: Wesley J. Sulak, 277 Canyon Dr., Whitney, TX (US) 28210

( * ) Notice: Under 35 U.S.C. 154(b), the term of this patent shall be extended for 0 days.

(21) Appl. No.: 09/326,533

(22) Filed: Jun. 7, 1999

(51) Int. Cl.[7] ..... F24B 1/181

(52) U.S. Cl. ..... 126/519; 126/25 R; 126/9 R; 126/506; 126/544

(58) Field of Search ..... 126/9 R, 25 R, 126/519, 506, 512; 110/317; D23/350

(56) References Cited

U.S. PATENT DOCUMENTS

| | | | | |
|---|---|---|---|---|
| 2,798,476 | * | 7/1957 | Marion, Jr. | 126/9 R |
| 2,924,212 | * | 2/1960 | Phillips et al. | 126/506 |
| 3,100,734 | * | 8/1963 | Rex, Jr. et al. | 110/317 |
| 3,301,249 | * | 1/1967 | Hendricks | 126/120 |
| 3,339,540 | * | 9/1967 | Kreider | 126/500 |
| 3,768,457 | * | 8/1963 | Beasey | 126/120 |
| 3,880,139 | * | 4/1975 | Young | 126/9 R |
| 4,159,016 | * | 6/1979 | Johnson | 126/506 |
| 4,216,760 | * | 8/1980 | Wiggins | 126/120 |
| 4,976,253 | * | 12/1990 | Beal et al. | 126/512 |
| 5,249,567 | * | 10/1993 | Maitland et al. | 126/519 |
| 5,579,755 | * | 12/1996 | Johnston | 126/25 R |
| 5,598,834 | * | 2/1997 | Grady | 126/506 |
| 5,836,298 | * | 11/1998 | Grady | 126/506 |

* cited by examiner

*Primary Examiner*—Ira S. Lazarus
*Assistant Examiner*—David Lee
(74) *Attorney, Agent, or Firm*—Peter Gibson

(57) ABSTRACT

Separable sections including a base section, a firebox section, and a chimney section form a free standing fireplace intended for use outdoors. In the assembled operational state the top chimney section fits over an opening through the top of the firebox section which fits, at the bottom, onto the top of the base section. In order to facilitate both transport and storage the sections may be configured so that the overall height and volume is much less than the overall height and volume of the fireplace in an operational state. The inverted chimney section may be largely disposed within the firebox section depending from the top of the same through an opening through the top of the firebox section and the base section then fitted on top of both depending downward exterior to the firebox section. At least one lateral opening to the inside of the firebox is provided for access to the interior and facilitation of viewing of a wood burning fire inside. Such a lateral opening may also be the only draft intake during use. Sheet steel is recommended for construction throughout. A cover, either a fire screen or a door, for each lateral opening is suggested as are locking caster wheels at the bottom of the base section. A grill may be added to facilitate cooking in which case a charcoal grate and provision for ventilation from underneath is also recommended.

20 Claims, 3 Drawing Sheets

11
16
15
10
25
21
20
14
12
20
22
31
30
33
13
34
37
32

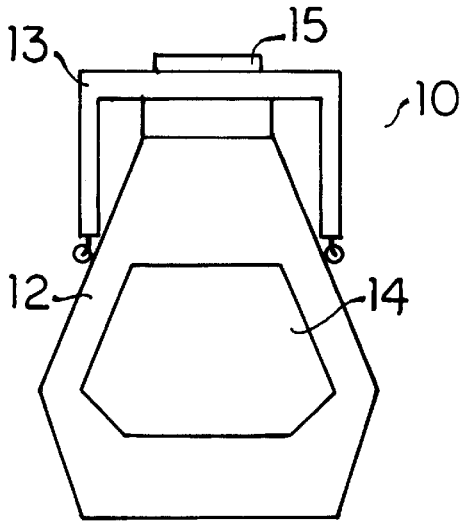
FIG 2
FIG 4
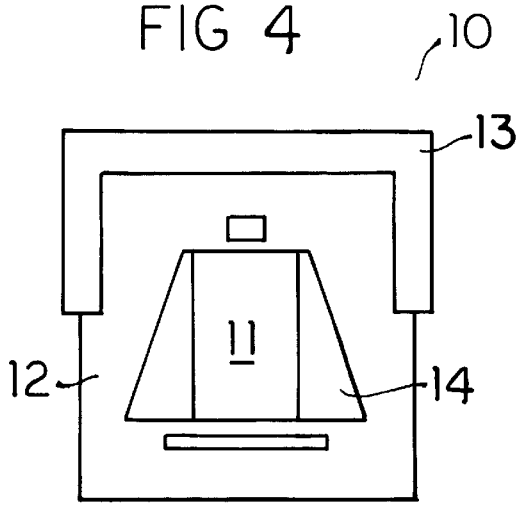
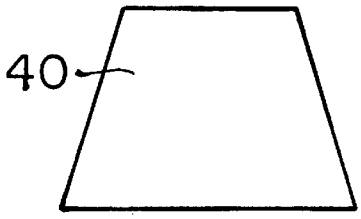
FIG 5
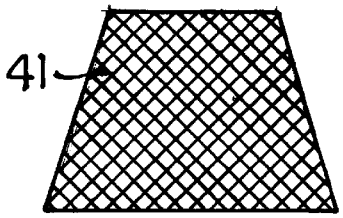
FIG 6
FIG 3
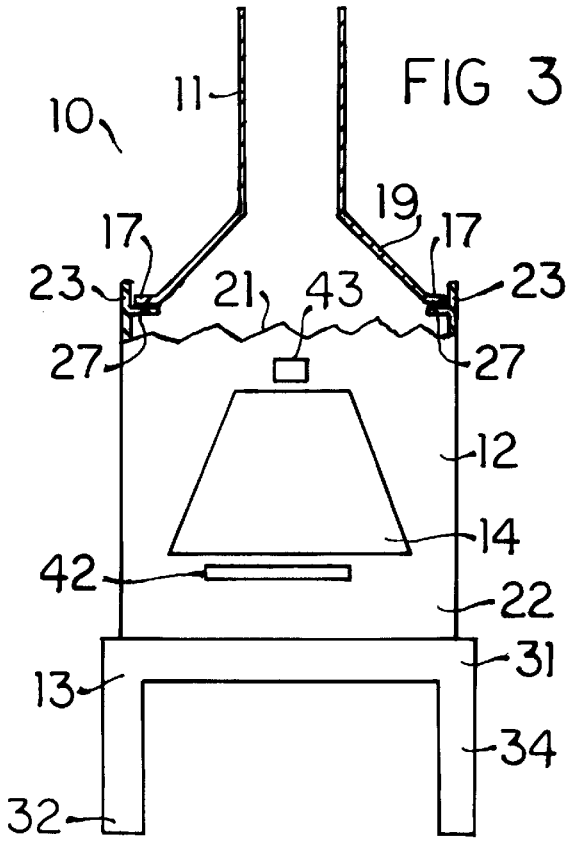

STOWABLE FIREPLACE

BACKGROUND OF THE INVENTION

1. Field of the Invention

The field of the present invention relates generally to fireplaces, firepots, or fireboxes, more particularly to sectional fireplaces, firepots, or fireboxes, and most specifically to sectional fireplaces, firepots, or fireboxes adapted for stowage.

2. General Background

Fireplaces today are considered generally to provide aesthetic pleasure as opposed to the utilitarian purposes of a furnace or stove. Historically, of course, fireplaces provided the only means of heating and cooking within a given household. Consequently a hearth or fireplace came to convey basic feelings of comfort and security. 'Keep the home fires burning' is a phrase and a song which is considered to indicate the profound depth of the human emotions associated with an operating fireplace wherein an elemental bond between people is recognized in the fire. Many definitions of man as opposed to animal have been suggested and other than addressing the matter theologically it is considered that the mastery of fire is about as good a distinction between man and beast as any other.

In short a fireplace, as opposed to a furnace or stove, is considered to provide something which is difficult to define but which is fundamental to the human race which has an aesthetic value in and of itself quite apart from the warmth and cooked food which formerly depended upon the wood burning fire. In the United States fireplaces are common to homes which possess central heating. Homes which rely upon a fireplace for the sole source of heating are considered comparatively rare in the United States currently. It is not uncommon to use a fireplace as an auxiliary source of heat but it is generally recognized as being more expensive than the primary source if not actually less than worthless with regard to heating a home because of the draft created, particularly if the damper is left open overnight because everyone retired prior to the fire burning out.

It is further considered that if wood is to be burned as a genuine means of providing heat in a home a cast iron stove does a much better job than a typical fireplace. Several aspects are concerned. A typical fireplace is brick or stone, disposed within a wall of a house, and has a brick or stone chimney extending upward as a part of that exterior wall of the house. Cast iron has superior specific heat retention and heat radiance to stone or brick and the stove is wholly within the house except for the portion of the chimney exterior to the same. A cast iron stove is hence considered to be generally recognized as a viable means of heating a structure largely comprised of a single large room such as a cabin and fireplaces are generally valued aesthetically.

A 'free standing fireplace', typically constructed of sheet steel and possessing at least one large window for viewing the burning fire, is considered as a sort of hybrid between a conventional built in fireplace and a cast iron stove. In contrast to the cast iron stove one may view the burning fire. In contrast to the built in fireplace the free standing fireplace provides good radiation of the heat produced. The sheet steel chimney is essentially the same as that typically utilized with a cast iron stove and being largely interior to the house and made of steel provide far more effective radiation of the heat carried through the same than is the case with a stone or brick chimney built into an exterior support wall of a static structure, i.e. building.

Fireplaces outdoors are also known, though mainly fires outdoors are established when and where desired with use of readily available materials such as rocks but what may be considered a fireplace outdoors is also well known in a form typically intended for use as grills and having concrete block construction. Many types of barbecue type grills are also known but none of these are intended for the burning of wood and hence none provide the aesthetic qualities discussed above with regard to a wood burning fireplace. Wood fires outside are also valued for the warmth obtainable therefrom and for enabling the cooking of food. However, there are a few drawbacks associated with the use of a wood fire built outside upon the ground regarding all three purposes.

Cooking upon an open wood fire is considered to be far more difficult than cooking on a grill. The warmth obtainable from such a fire is also often less than fully satisfactory. In truly cold weather an open fire generally has a very narrow range in which genuine comfort can be found. If one is facing the fire, moreover, one's back does not benefit in the obtainment of warmth from the fire and vice versa. And, thirdly, open wood fires built upon the ground have an unpleasant tendency to spread and are generally dangerous if not illegal if built in places other than those specifically designated for a camp fire. The building of an open wood fire upon the ground is hence generally restricted to established camp fire sites and it is considered that many people would enjoy the ability to view a wood burning fire outdoors in locations lacking safe or legal sites for camp fires.

In particular, it is considered that many people would like to enjoy a wood burning fire upon a deck of a house but a deck is typically made of wood and burns quite readily. Construction of a fireplace in brick or stone is simply not feasible upon a deck and while the use of grills of various sorts upon a wood deck is considered to be widely practiced a grill is for cooking and is neither intended to burn wood nor permit viewing of a fire therein.

Discussion of the Prior Art

Following is a chronological listing of references considered pertinent to the present invention which are each briefly discussed further below in the same order.

| U.S. Pat. No. | Inventor | Date | Title |
|---|---|---|---|
| 21,938 | Buchanan | 2 Nov. 1858 | Stove |
| 90,537 | Helm | 25 May 1869 | Heating Stove |
| 110,274 | Old | 20 Dec. 1870 | Heating Stove |
| 313,441 | Nativel | 3 March 1885 | Fire Place And Chimney |
| 363,210 | Cooper | 17 May 1887 | Portable Fire Place and Flue |
| 1,342,329 | Freeman | 1 June 1920 | Chimney |
| 3,339,540 | Kreider | 5 Sept 1967 | Portable Pre-Cast Fireplace |
| 3,499,432 | Hannebaum | 10 March 1970 | Heating Unit |
| 4,112,913 | Shimek et al. | 12 Sept 1978 | Free Standing Heating Unit |
| 4,461,272 | Larsson et al. | 24 July 1984 | Kachelofen |

Buchanan discloses a sectional stove with a chimney top that is elevationally adjustable by means of a screw engaging an upright and with a base having legs which is all round in cross section taken normal the vertical axis. A third section comprised of an open grate or fire chamber is nested within the base and the chimney is bell shaped at bottom tapered into a truncated cone.

Helm discloses a bottle shaped 'Heating Stove' constructed of relatively thin and uniform cross section cast steel which sits on a base with legs and has sliding doors for a plurality of radial openings which rest upon a ledge effected by an inset of the exterior sidewall. The upper part of the shell is necked and flares outward terminating in a horizontal top roof through which a vent is made. An open concave grate hangs from the bottom of the shell which is supported by legs in the legged base. The grate may be inverted to extend upward into the shell if desired.

Old discloses a heating stove which is mainly equipped with an internal mechanism using lugs riding inclines to provide vertical agitation in addition to rotational with rotation of a handle in a horizontal plane in order to more efficiently combust coal. The basic shell construction is in three sections: (a) an ash box which serves as a base and extends cylindrically upward upon which rests; (b) an egg shaped shell in which the fire box is located with a circular rim at top upon which rests; (c) an upper conical part which terminates in a circular opening.

Nativel discloses a sectional fire place and chimney possessing three main portions: the generally cylindrical fire place made of a plurality of stacked sections; the cylindrical chimney H also made of a plurality of stacked sections of reduced diameter; and a medial "top plate G" which possesses concave sides and a generally conical shape which is one piece and provides for the substantial diameter reduction between fireplace and chimney.

Cooper discloses a 'Portable Fire Place and Flue' which is comprised of several different sections including a rectangular firebox comprised of a double wall, the outside being wood or other suitable material, the inside being sheet steel, the space in between meant to be filled with dirt or other suitable material and the entire device further meant to be disposed upon a foundation of stone or brick.

Freeman discloses a 'Chimney' which:

> "has reference to a novel construction of portable fire places for use in camps or like situations and the principal object of the invention is to provide a device of this nature made up of a plurality of easily assembled parts constituting a fire place and a chimney."

The rectangular flat bottom base has grooves into which tongues of base blocks are fit. Similarly, the "upper part" of the fire place is fit on top the base blocks and the chimney fit on top of this.

Kreider discloses a 'Portable Pre-Cast Fireplace' which has a relatively shallow dish shaped base and a rounded, generally conical, cast concrete shell with a top bore into which a cylindrical chimney is disposed. Hannebaum discloses a free standing fireplace with a generally round shape with a cylindrical base opening out to a medial section enclosed by a plurality of contiguous glass panes vertically disposed in a polygon which is topped by a conical section terminating in a cylindrical chimney.

Shimek et al. disclose a free standing fireplace very similar to that disclosed by Hannebaum but with a central draft intake as opposed to a radial intake. Larsson et al. disclose a concentric upward, downward, upward vertical path for the draft of a stove which "has three coaxially nested tubular columns" (Abstract).

In summary it is considered that a number of sectional stoves and furnaces are known including the use of a straight sectioned chimney, a tapered portion medial to the firebox and the chimney, at least one lateral aperture to the firebox and a base section with or without legs, none of these disclose an arrangement of sections which substantially reduces the height and volume required of the unit in comparison with the height and volume of the unit in an operational state.

Statement of Need

The above discussed prior art is characterized by construction utilizing separable components or sections. While this construction does facilitate transportation in that the entire structure need not be moved as an integral and excessively heavy and cumbersome unit, no provision is found for the reduction of space required of the sections in aggregate. While construction in sections hence is known which essentially facilitates transport once to a given site, repeated transportation and storage during the intervals between use, which is considered to be characteristic of a genuinely portable fire box, would both clearly benefit from the capability of reducing the space required of the device. It is further considered that in the case of desiring a wood burning fire upon a deck, i.e. a wooden platform structure typically adjacent the exterior of a residence, movement of a fire place about the deck and storage of a fireplace in a compact and neat manner are also desirable. It is hence considered that a need therefore exists for a firebox made of separable sections which may be configured to occupy less space than required of the device when in operation.

SUMMARY OF THE INVENTION

Objects of the Invention

The encompassing object of the principles relating to the present invention is a fire place which in an assembled operational state enables the viewing of a wood burning fire therein which is comprised of sections which may be arranged in a manner such that the space required of the disassembled fire place is considerably less than the space required of the fire place in an assembled operational state.

Ancillary objects of the principles relating to the present invention include elevation of a firebox above the ground in order to avoid both scorching of a platform therebeneath and to improve the ability to view a wood burning fire within; providing effective radiation of the heat generated by a wood burning fire within the firebox; facilitating movement of the fire place; durable and inexpensive construction.

Principles Relating To The Present Invention

In achievement of the above stated objectives a basic construction comprised of chimney section, a firebox section and a base section is proposed. In an assembled operational state the base section elevates the firebox section seated thereupon and the chimney section extends upward over an opening through the top end of the firebox. The chimney section is open at either end and is substantially hollow. The firebox section is necessarily open at the top end and substantially hollow. The bottom end of the firebox is preferably closed and at least one lateral opening to the interior of the firebox section provides the draft intake though the bottom end of the firebox might possess a vent in provision of a supplementary intake draft.

For transportation or storage, i.e. stowage, of a fireplace in accordance with the principles relating to the present invention the chimney section is placed in an inverted state depending from the top end of the firebox section, extending downward through the opening through the same, thereby disposing the chimney section largely inside the firebox section. The base section may be placed on top of the inverted bottom of the chimney section at the top of the firebox section and be disposed exteriorly to the firebox section in an upright state if the bottom of the base section is open, as is preferred.

A fireplace in accordance with the principles relating to the present invention is hence 'stowable', i.e. readily stowed, in the first and main meaning of the word as given by the *American Heritage Dictionary,* 2nd College Edition, 1982: "1. To place, arrange, or store away, especially in a neat, compact way". Stowage is the act, manner, or process of stowing and is also historically associated with ships, as witnessed by the word stowaway. A secondary capability regarding facilitation of transport is hence recognized which is considered wholly appropriate to the use of the term 'stowable' herein as connoting the capability of being arranged in a compact manner wherein compact is considered to mean requiring less height and volume in comparison with another arrangement such as that utilized for operation.

Construction in sheet steel is recommended in order to provide good heat radiating qualities, durability, and low manufacturing cost. Generally symmetrical shape about one or more vertical planes through a vertical axis common to the assembled sections is also recommended to facilitate construction and ease in both assembly and stowing of the various sections for transport or storage. Polygonal construction with four faces for each section is preferred, particularly with an upper portion tepered inward and a lower portion tapered outward from bottom to top, while radially concentric and polygonal construction with three main faces are also specifically suggested.

Regardless of the geometric shapes utilized the firebox section has a open upper end to which the bottom end of the chimney section is fitted in the operational assembly. Stability may be obtained by overlapping sleeves in which case an exterior collar to the chimney section is recommended as a stop against vertical displacement both in the assembled operational state and the stowed state. Alternatively, an outwardly extending flange about the chimney section might be disposed upon an inwardly extending flange about the open top end of the firebox section and retained by a peripheral lip extending upward therefrom or secured by other means.

Similarly, the bottom end of the lower firebox section, which is preferably closed though a vent may be added, may fit onto and be supported by a base section which elevates the firebox and enhances both safety and viewing of a wood burning fire therein for which at least one lateral opening is presented by the firebox. The base preferably is hollow and possesses one open end and an interior of sufficient dimension to permit disposition of the base section over the top end of the firebox section, exterior to the same, regardless of whether the chimney section is first stowed as described above. Either end may be open for this purpose and both ends may be substantially open though support of the bottom end of the firebox by the top end of the base section is necessary.

It is further considered that wheels, preferably of a locking caster type, may be added to the base section as particularly useful for moving the assembled firebox about a patio or deck. And it is also considered that provision for cooking may be readily gained with appropriate additions such as venting for the bottom of the lower firebox portion, grating in the lower firebox portion, and means of supporting a grill and/or skewers for barbecue.

BRIEF DESCRIPTION OF THE DRAWINGS

FIG. 2 is a plain elevational view taken from a side of a first preferred embodiment in accordance with the principles relating to the present invention shown in a stowed state suited to facilitating storage or transportation.

FIG. 3 is an plain elevational view taken from the front of a second preferred embodiment in accordance with the principles relating to the present invention shown in an assembled operational state.

FIG. 4 is an plain elevational view taken from the front of a second preferred embodiment in accordance with the principles relating to the present invention shown in a stowed state suited to facilitating storage or transportation.

FIG. 5 is a plain elevational view taken from the front of a fire screen suited to use upon the second preferred embodiment of the principles relating to the present invention depicted in FIG. 3.

FIG. 6 is a plain elevational view taken from the front of a cover suited to use upon the second preferred embodiment of the principles relating to the present invention depicted in FIG. 3.

| NOMENCLATURE | |
|---|---|
| 10 | sectional fire place |
| 11 | chimney section |
| 12 | firebox section |
| 13 | base section |
| 14 | lateral opening |
| 15 | bottom end of chimney section |
| 16 | collar |
| 17 | outward flange |
| 19 | lower hood portion |
| 20 | firebox sidewall(s) |
| 21 | upper end of firebox section |
| 22 | lower end of firebox section |
| 23 | lip |
| 25 | external sleeve |
| 27 | inward flange |
| 30 | opening through 31 |
| 31 | top end of base section |
| 32 | bottom end of base section |
| 33 | lip about 31 |
| 34 | legs |
| 37 | wheels |
| 40 | fire screen |
| 41 | door |
| 42 | flanged lip |
| 43 | clip |

DETAILED DESCRIPTION OF THE INVENTION

Figure 1:
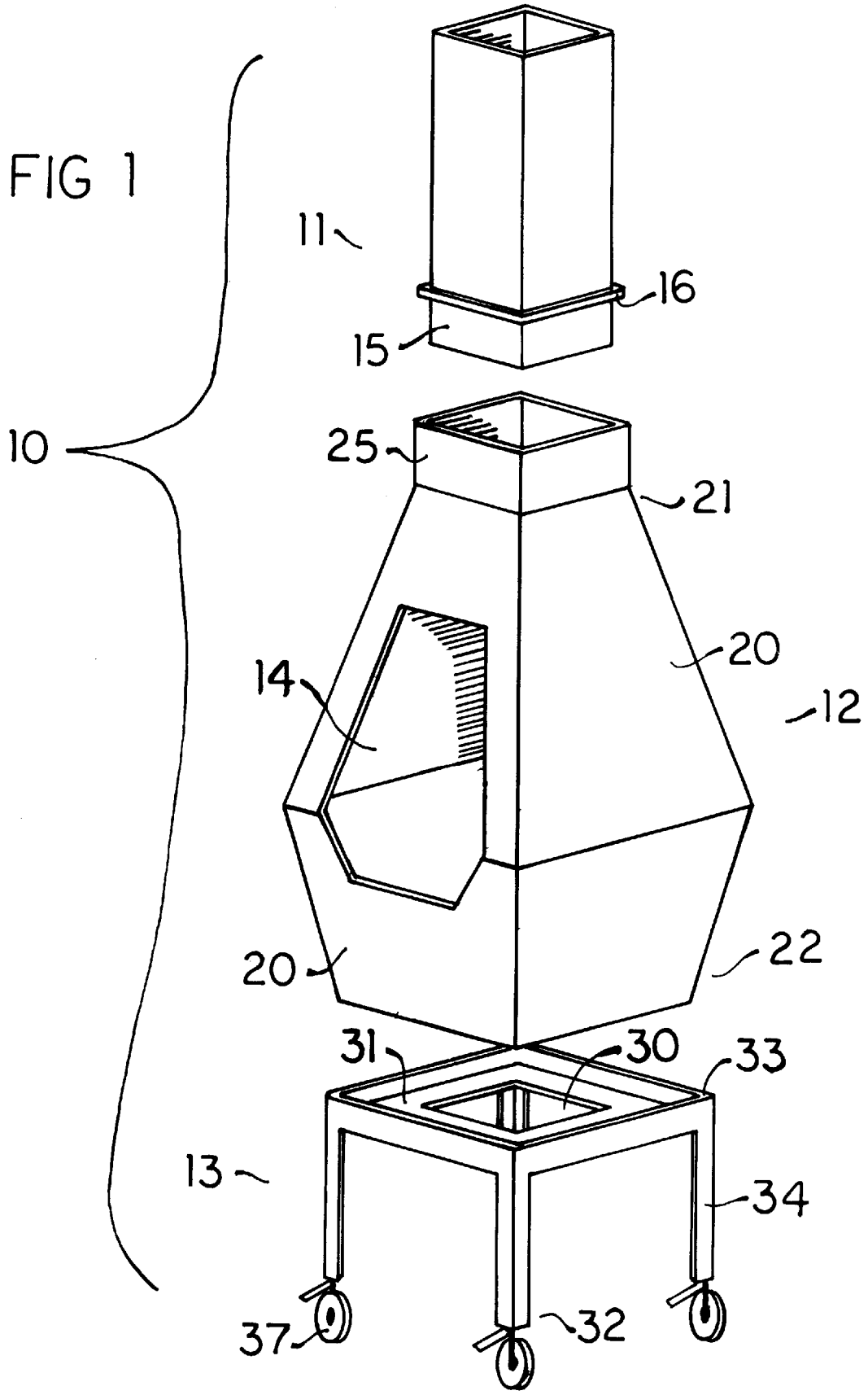
FIG. 1 is an isometric view of a first preferred embodiment in accordance with the principles relating to the present invention shown in an exploded view indicating the assembly required to obtain the operational state.

FIG. 1 depicts a sectional fire place 10 in accordance with the principles relating to the present invention in an assembly view clearly depicting three basic components: a chimney section 11, a firebox section 12, and base section 13. A lateral opening 14 is seen through a sidewall 20 of the firebox section 12. Assembly of the chimney section 11 with the firebox section 12 is effected as shown with seating of the lower end 22 of the firebox section 12 within the open upper end 31 of the base section 13 and insertion of the bottom end 15 of the chimney section 11 below the collar 16 into the upright external sleeve 25 extending upward from the upper end 21 of the firebox section 12. This effects an overlapping juncture between the two components which is quite stable.

As further indicated in FIG. 1 the firebox section is seated upon the top end 31 of the base section 13 which possesses an upward extending peripheral lip 33. Because the sidewalls 20 of the firebox 12 taper slightly outward in an upward direction from the lower end 22 of the same the lip 33 about the top end 31 of the base section 13 also may contact the sidewalls 20 of the firebox 12 rather than or in combination with contact between the lower end 23 of the firebox section 12 with the top end 31 of the base section 13 which is seen in FIG. 1 to consist of a substantially horizontal support surface possessing a square opening 30 therethrough. The lip 33 about the top end 31 of the base section 13 may further be given a slight taper outward corresponding to the taper possessed of the sidewalls 20 proximate the lower end 22 of the firebox section 12 for maximum lateral contact and stability.

The base section 13 depicted in FIGS. 1 & 2 is further seen to have legs 34 each with a wheel 37 at the bottom end. This is strictly an optional feature and is considered desirable to those intending to use the device on a patio or deck surface primarily. Locking caster type wheels 37 of conventional manufacture are preferred. It is also noted that the base section 13 may be constructed of L-shaped steel legs 37 and L-shaped steel top end 31 though unequal length legs are indicated here if the opening 30 through the top end 31 of the base section 13 is dimensioned as seen in FIG. 1 to fit fairly closely about the bottom end 15 of the chimney section 11 when the latter is inverted for storage as depicted in FIG. 2 as described below.

FIG. 2 depicts the same embodiment of the principles relating to the present invention shown in FIG. 1 configured in a stowed state in which the overall height and volume is considerably reduced. The chimney section 11 has been inverted and largely disposed within the firebox section 12 with only the bottom end 15 of the chimney section 11 distal to the collar 16 protruding from the open upper end 21 of the firebox section 12. The base section 13, as clearly seen in FIG. 2, has an opening 30 through the top end 31 through which the bottom end 15 of the chimney section 11 extends. This is a strictly optional feature. It generally preferred that the top end 31 of the base section 13 possess an opening 30 therethrough in order to save weight primarily.

Sizing the aperture to the bottom end 15 of the chimney section 11 will provide additional stability but the basic structure wherein the bottom end 31 of the base section 13 is open and of sufficient dimension along with the interior of the base section 13 to straddle the upper end 21 of the firebox section the configuration easily possesses excellent stability. It may also be preferred to utilize a closed top end 31 of the base section 13 so that a cover is provided for the stowed chimney and, perhaps more importantly, a usable horizontal surface is presented thereby.

It is emphasized that the detailed discussion above regarding the embodiment of the principles relating to the present invention depicted in FIGS. 1 & 2 is particular in many aspects to that embodiment and that many such aspects may be changed in fulfillment of said principles. The geometry may be changed in any manner so long as the basic components can be configured in an operational state and a stowed state as defined herein.

FIG. 3 depicts an embodiment of the principles relating to the present invention possessing a base section 13 substantially similar to that depicted in FIGS. 1 & 2 with a firebox section 12 comprised of four flat substantially vertical sidewalls 20. The chimney section 11 and the manner of fitting the same above the open upper end 21 of the firebox section 12 is much different than that described above. As clearly seen in FIG. 3 the open top end 21 of the firebox section 12 is bounded by an inward flange 27 upon which rests an outward flange 17 of the bottom end 15 of the chimney section 11 which is further enclosed laterally by a lip 23 extending upward from the periphery of the upper end 21 of the firebox section 12. The chimney section 11 further possesses a lower hood portion 19 with inclined walls as seen which effect the reduction in cross sectional area observed between the firebox portion 12 and the upper portion of the chimney section 11.

The lateral opening 14 seen in FIG. 3 is further observed to have a flanged lip 42 along the bottom and a clip at the top intended to support either a cover, either a fire screen 40 such as that depicted in FIG. 5 and/or a door 41 such as that depicted in FIG. 6 with the bottom edge of either supported by the flanged lip 42 and the top edge held by the clip 43. If both a fire screen 40 and a door 41 are to be accommodated at the same time a double flanged lip 42 and double width clip 43 might be utilized, however, it is considered that it is likely that use of only one or the other will be desired at any given time and that a single flanged lip 42 will be fully satisfactory.

Alternatively, a cover, i.e. a fire screen 40 and/or door 41 might be attached to the firebox section 12 by the use of hinges along the bottom of the lateral opening offset from the exterior of the sidewall 20. A clip 43 at top or catch for the door 41 and/or fire screen 40 is suggested for holding each in an open position in this case. Also, a fire screen 40 and/or a door 41 might each be hinged to a side of the lateral opening 14 and be supported by the hinges whether closed or open. If both a fire screen 40 and a door 41 are used it is suggested that the door be hinged outside to the fire screen 40. In any case both handles and the use of gloves or other implement is recommended in displacement of a fire screen 40 or door 41 that has been in position upon a firebox section 12 with a fire inside in order to avoid blistering one's fingers.

FIG. 4 depicts the same embodiment of the principles relating to the present invention depicted in FIG. 3 in a stowed state with the chimney section 11 inverted and disposed almost entirely within the firebox section 12 and the base section 13 fitted on top. This configuration achieves a reduction of more than half the height required of the operational state and a similar reduction in volume require. The result, moreover, is a veritable cube which is considered extremely compact, and if the top end 31 of the base section 13 is closed, a substantially square, horizontal, surface is obtained.

Figure 7:
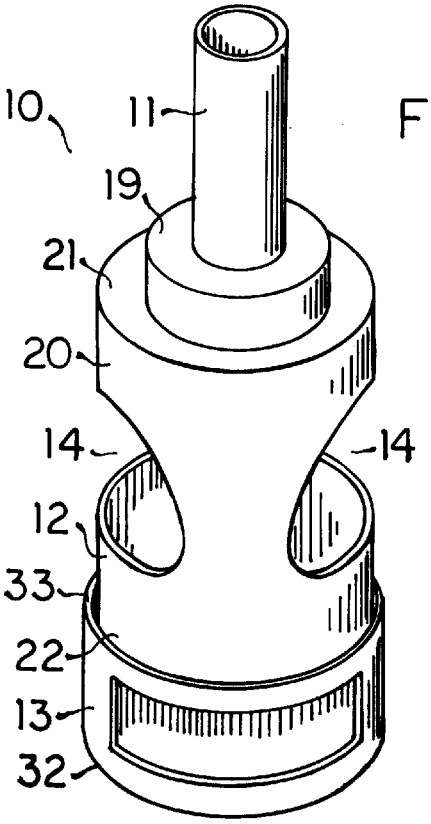
FIG. 7 is an isometric view of a third preferred embodiment in accordance with the principles relating to the present invention shown in an assembled operational state.

FIG. 7 depicts an embodiment of the principles relating to the present invention which is comprised of basically cylindrical components. The nearly cylindrical firebox section 12 is also seen to have more than one lateral opening 14 but is otherwise similar to that depicted in FIG. 4. The base section 13 is seen to comprise of two circular bands fixedly spaced apart from each other in parallel by a plurality of legs 34 which do not contact an underlying support surface directly. The bottom end 32 of the base section is open, in order to permit stowing of the same on top of the chimney section 11 inverted through the open top end 21 of the fire box section 12 as described earlier.

The chimney section depicted in FIG. 7 possesses a lower hood portion 19 which lacks inclined sides but effects the reduction necessary between the firebox section 12 and the upper portion of the chimney section 11. A truncated cone which would have an inclined sidewall is also specifically recommended in place of the straight sidewalls possessed of the lower portion of the chimney section 11 depicted in FIG. 7. This aspect of the embodiment of the principles relating to the present invention depicted in FIG. 7 is considered to be somewhat characteristic of the structure illustrated, however, the chimney section 11 shown is comprised of two cylindrical portions with an interposed flat horizontal surface similar to the top end 21 of the firebox 12. This is the most economic approach to construction of an embodiment of the principles relating to the present invention known.

Figure 8:
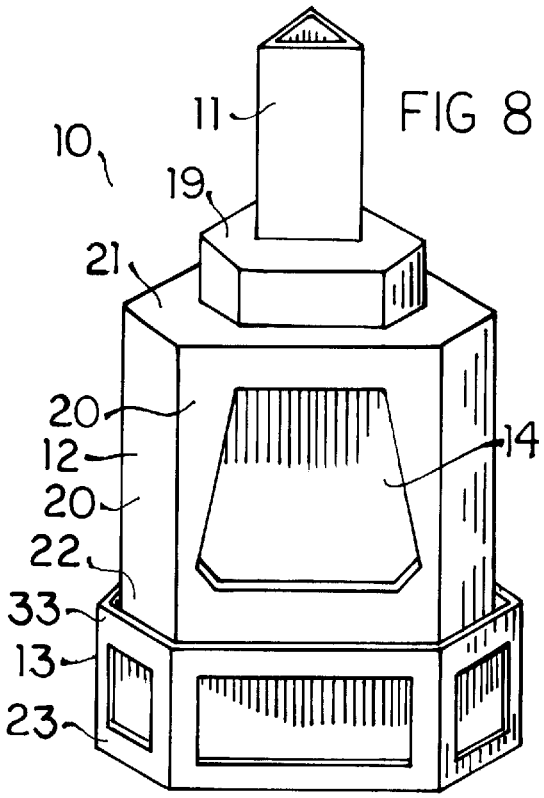
FIG. 8 is an plain elevational view taken from the front of a fourth preferred embodiment in accordance with the principles relating to the present invention shown in an assembled operational state.

FIG. 8 depicts an embodiment of the principles relating to the present invention possessing a generally prismatic shape. The upper portion of the chimney section 11 possesses a simple three sided or prismatic shape while the lower hood portion 19 and the upper firebox section 12 both have three main sides with chamfered corners in effect. A congruently shaped base section 13 is also seen. As regards both the stability of the operational and stowage states of the components the discussion above is considered applicable. In the stowed state the overall height, as in the embodiment depicted in FIG. 7, will equal the height of the firebox section 12 and that of the lower hood portion of the chimney section 11. The embodiment depicted in FIG. 8 is considered more aesthetically pleasing than those depicted in FIGS. 3 & 7 and will also cost more to manufacture. In this connection it is also mentioned that the embodiment depicted in FIG. 1 is mainly preferred over the others for aesthetic reasons.

It is further observed that the embodiment of the principles relating to the present invention depicted in FIG. 8 is symmetric about six planes taken through a central vertical axis, that the embodiment depicted in FIG. 1 is actually symmetric about eight planes through a similar axis with the exception of the single lateral viewing opening 14, and that the embodiment depicted in FIG. 7 is basically, with the exception of the lateral openings 14, symmetric about any plane through a central vertical axis. This symmetry is considered largely coincidental to the objects of simplifying construction and facilitating both assembly and stowing of the components. Without symmetry only a single radial orientation for each component in the assembled and perhaps the nested configurations might result and construction would be similarly restricted.

The detailed discussion above is intended to provide one practiced in the art with an appreciation of the basic and novel aspects of an embodiment of the principles relating to the present invention. As mentioned earlier the primary use of such an embodiment is simple enjoyment of a wood burning fire outside in a manner that is safe and which facilitates transportation and storage in having the capability of being considerably reduced in space, or volume, required in a state achieved by an arrangement of the components which is opposed to the operational state.

Modifications and additions to these fundamentals are readily devised in accordance with known practice relating to secondary concerns and specific usages. Primarily, it is recognized that the capability of cooking upon the operational fire place may be desired and that this may be facilitated with either a grill or skewer. In either case it is considered that a vent, preferably closable, upon the lower end 22 of the firebox section 12 may be desirable. The use of of or more skewers may be simply accommodated with horizontally aligned small apertures through the sidewall(s) 20 of the firebox section 12. A substantially square grill of appropriate dimensions is readily seated at a given height in the lower part of the firebox section 12 depicted in FIG. 1 because of the inwardly sloping sidewalls 20. For the same reason an appropriately dimensioned charcoal grate may readily be disposed beneath the grill.

It is further recommended, regardless of the embodiment of the principles relating to the present invention pursued, that a simple ash pan be disposed at the bottom of the interior of the firebox section 12 to aid in the removal of ashes. If the firebox possesses substantially straight sidewalls it is recommended that at least one set of supports comprised of a plurality of small internal substantially horizontal projections from the interior surface of the sidewalls 20 be added for the purpose of supporting a grill and another set of supports be added for a charcoal grate. Multiple sets of supports for the grill will enable variation of elevation above a bed of coals upon the grate.

The foregoing is intended to provide one practiced in the art with what is considered the best manner known of making and utilizing an embodiment of the principles relating to the present invention; it is not to considered restrictive of scope of the invention disclosed herein or of the rights and privileges obtained by Letters Patent securing property to the same for which I claim:

1. A sectional fireplace intended to enable safe viewing of a wood burning fire therein in an operational state which may be configured in a stowage state possessing a considerably reduced height and volume, said sectional fireplace comprising:

a substantially hollow chimney section comprised of one integral piece open at each of two opposed ends, a substantially hollow firebox section comprised of one integral piece open at an upper end and possessing at least one lateral opening through a sidewall, and a substantially hollow base section comprised of one integral piece possessing a top end and a bottom end of which at least one is open;

said chimney section having a bottom end fitting over and supported by the open upper end of said firebox and said firebox section possessing a lower end fitting onto and supported by said top end of said base section whereby a fire inside said firebox section is elevated by said base section and each said lateral opening through said sidewall of said firebox section provides an intake draft and said chimney section provides an exhaust draft;

said chimney section and said open upper end of said firebox section both being dimensioned to permit insertion of an upper end of said chimney section through said open upper end of said firebox section thereby disposing a substantial portion of said chimney section within said firebox section;

said base section and said firebox section being dimensioned to permit positioning of one said open end of said base section about said upper end of said firebox section thereby disposing a substantial portion of said base section exterior to said firebox section and thereby providing a usable horizontal surface.

2. The fire place of claim 1 possessing more than one lateral opening.

3. The sectional fire place of claim 1 wherein said bottom end of said firebox section is closed.

4. The sectional fire place of claim 1 further possessing a plurality of wheels fixed to said bottom end of said base section.

5. The sectional fire place of claim 4 wherein said wheels are of a locking caster type.

6. The sectional fire place of claim 1 wherein said top end of said firebox section possesses an upward sleeve mating said bottom end of said chimney section.

7. The sectional fire place of claim 6 wherein said bottom end of said chimney section is defined by a collar acting as a stop against further vertical displacement of said bottom end of said chimney section in mating said upward sleeve.

8. The sectional fire place of claim 1 wherein said firebox section possesses four sidewalls.

9. The sectional fire place of claim 8 wherein said firebox section possesses a lower portion and an upper portion, said four sidewalls tapering outward in said lower portion and tapering inward in said upper section from bottom to top.

10. The sectional fire place of claim 1 further possessing a provision for fitting a cover over each said lateral opening including a substantially horizontal flanged lip below said lateral opening.

11. The sectional fire place of claim 1 further possessing a provision for fitting a cover over each said lateral opening including a resilient clip above said lateral opening.

12. The sectional fire place of claim 1 wherein said firebox possesses substantially vertical sidewalls.

13. The sectional fire place of claim 12 possessing four sidewalls.

14. The sectional fire place of claim 12 possessing one cylindrical sidewall.

15. The sectional fire place of claim 12 possessing three principal sidewalls.

16. The sectional fire place of claim 1 wherein said chimney section possesses a lower hood section extending outward from an upper portion.

17. The sectional fire place of claim 16 wherein said lower hood section extending outward from an upper portion possesses inclined sidewalls.

18. The sectional fire place of claim 16 wherein said bottom end of said chimney section possesses an outward flange at the bottom.

19. The sectional fire place of claim 18 wherein said open upper end of said firebox section possesses an inward flange.

20. The sectional fire place of claim 18 wherein said open upper end of said firebox section possesses a peripheral lip extending upward.

* * * * *